US005537798A

United States Patent [19]

Fukuda et al.

[11] Patent Number: 5,537,798

[45] Date of Patent: Jul. 23, 1996

[54] PACKAGE MAKING MACHINES AND SYSTEMS

[75] Inventors: Masao Fukuda; Osamu Hashimoto, both of Shiga, Japan

[73] Assignee: Ishida Co., Ltd., Japan

[21] Appl. No.: 302,158

[22] Filed: Sep. 8, 1994

Related U.S. Application Data

[63] Continuation-in-part of Ser. No. 76,335, Jun. 4, 1993, abandoned, which is a continuation-in-part of Ser. No. 960,375, Jan. 4, 1993, abandoned.

[51] Int. Cl.[6] ..... B65B 57/00; B65B 57/18; B65B 59/00

[52] U.S. Cl. ..... 53/55; 53/168; 53/201; 53/507; 53/451

[58] Field of Search ..... 53/201, 168, 507, 53/451, 552, 551, 64, 77, 508, 52

[56] References Cited

U.S. PATENT DOCUMENTS

| | | | |
|---|---|---|---|
| 3,688,414 | 9/1972 | Koehlinger et al. | 53/507 X |
| 3,815,313 | 6/1974 | Heisler | 53/168 X |
| 4,554,777 | 11/1985 | Denk et al. | 53/201 |
| 4,751,805 | 6/1988 | Walter | 53/168 |
| 4,999,979 | 3/1991 | Vicq | 53/201 X |

FOREIGN PATENT DOCUMENTS

| | | |
|---|---|---|
| 56-142128 | 11/1981 | Japan . |
| 59-84721 | 5/1984 | Japan . |
| 63-6404 | 2/1988 | Japan . |
| 63-248606 | 10/1988 | Japan . |
| 1-167023 | 6/1989 | Japan . |

*Primary Examiner*—James F. Coan

*Attorney, Agent, or Firm*—Majestic, Parsons, Siebert & Hsue

[57] ABSTRACT

A packaging machine responds, when a kind of merchandise to be produced, the film or the former which is installed thereon is inputted through a touch panel, by causing its microcomputer to compare the inputted data with the data stored in a read-only memory circuit on merchandises, films and/or formers, to display the merchandise, the identification numbers and pictorial patterns of films and/or the sizes and storage location of formers which correspond to the inputted data, and to select an appropriate merchandise, film and/or former.

13 Claims, 11 Drawing Sheets

| MERCHANDISE NUMBER | FILM NUMBER | FILM LOCATION | BAR CODE | PATTERN | SLIDE DISTANCE FOR DIAGONAL ROLL |
|---|---|---|---|---|---|
| A | #100 | S 01 | 491000101 | | 0 |
| B | #101 | S 02 | 491000102 | | 20 |
| C | #102 | S 03 | 491000103 | | 23 |
| ... | ... | ... | ... | ... | ... |

FIG._6A

| MERCHANDISE NUMBER | FORMER NUMBER | FORMER SIZE | FORMER LOCATION | CODE DATA | STOP POSITION DATA |
|---|---|---|---|---|---|
| A | #01 | 5" | F 01 | 1000 | 1500 |
| B | #02 | 5 1/4" | F 02 | 1001 | 1600 |
| C | #03 | 5 1/4" | F 03 | 1010 | 1600 |
| ... | ... | ... | ... | ... | ... |

FIG._6B

| MERCHANDISE NUMBER | OPERATION SPEED (MINUTE) | | BAG LENGTH | SEALING CONDITIONS | | |
|---|---|---|---|---|---|---|
| | PULL DOWN | TRANSVERSE SEAL | | TEMPERATURE | PRESSURE | TIME |
| A | 1200 cm | 60 | 200 | 150 | 2 | 500 |
| B | 1500 cm | 60 | 250 | 160 | 2 | 600 |
| C | 1800 cm | 60 | 300 | 160 | 1 | 600 |
| ... | ... | ... | ... | ... | ... | ... |

PACKAGE MAKING MACHINES AND SYSTEMS

This is a continuation-in-part of application Ser. No. 08/076,335 filed Jun. 14, 1993, now abandoned, which is a continuation-in-part of application Ser. No. 07/960,375 filed Jan. 4, 1993, now abandoned.

BACKGROUND OF THE INVENTION

This invention relates not only to so-called form-fill-seal type package making machines (hereinafter referred to simply as packaging machines) for making bags from a film-like packaging material and concurrently filling them with articles to be packaged, but also to package making systems which include storage means for storing formers and films of different kinds as well as a packaging machine. More particularly, this invention relates to packaging machines and systems which allow the user to efficiently select and install an appropriate former and a correct packaging material out of many different kinds which may be available, depending upon what kinds of packages are to be produced, say, according to a given production schedule.

Consumers' needs and demands are increasing. Consider potato chips, for example. Not only potato chips with different flavors, such as salt-flavored, cheese-flavored, onion-flavored and vinegar-flavored potato chips but those with different levels of flavoring are expected to be available. Moreover, consumers want packages of various sizes available even where the articles packaged inside are the same. Since each different item of packaged goods (hereinafter referred to as item), whether different in the kind of packaged articles inside or in their weight, must be marked differently, say, by bar codes, and since certain packaging materials, such as unmarked transparent or aluminum coating films, can be used in common for different items, the manufacturer is usually required to have in store more different kinds of packaging materials (hereinafter referred to as films) than the number of different items to be produced. Similarly, formers of different sizes and designs are usually required, depending on the size and design of the bags to be formed for different items. Although the number of different formers required is generally much smaller than the total number of different films which a manufacturer is typically required to be provided with, management and handling of different films and formers are a very complicated task. In the case of potato chips which look alike but are differently flavored, for example, an error can be committed easily and packaged bags with the design not matching the contents may be produced. As another example, an inexperienced operator will not find it easy to distinguish a former of size 5 inches from another of size 5 and ¼ inches. If a wrong former is erroneously installed, many unmerchantable products will be produced as a result. In summary, where large numbers of formers and films must be used to produce many different items, the job of selecting a correct one out of a large choice becomes cumbersome. This gives rise to the problem of lowered productivity.

At a manufacturing plant, many different items are usually produced each day according to a production schedule. After one of the items on such a schedule is selected, a correct film and a correct former corresponding to the selected item must be identified and retrieved before they can be installed on the packaging machine. This may be done by entering into an inputting device a code representing the selected item, but it is not necessarily an easy task to look up the correct code.

A beginner may find it troublesome, and input errors are likely to occur.

In many situations, the schedule for a day may call for production of many different items but it may not really matter in which order they are produced. Where the film and/or the former which was used last on the day before remains installed on the packaging machine at the beginning of the day, for example, it is more efficient to start the day by producing an item for which the already installed film and/or former can be used. Thus, a general object of the present invention is to provide a system for making packages including a packaging machine of form-fill-seal type which can be operated with high efficiency even in situations where different packaged items must be produced sequentially each by using a film and a former which have been correctly selected. Other specific objects of the invention will be described below.

SUMMARY OF THE INVENTION

A packaging system including a packaging machine embodying the present invention and capable of accomplishing the aforementioned general object, as well as other specific objects to be described below, may be characterized firstly as comprising, in addition to a data input means and a display screen of known kinds, a control means such as a microcomputer having a memory device which store data such as indicating which of the available films and formers should be used on the packaging machine for the production of each item. It should be remembered in this connection, as mentioned above, that two or more different films and/or formers may be usable for the production of an item.

Secondly, a packaging system according to the present invention may be characterized as having various detectors. One of such detectors is for detecting which of the available formers is on the packaging machine and another is for detecting which of the available films is currently installed. All the other films and formers, which are not on the packaging machine, are assumed to be stored in their respective storage houses. These storage houses may be managed such that each film and former is assigned its own storage location therein. If they are not so managed, and films and formers are stored at random locations, each location is provided with one of such detectors such that the control means can keep track of where to find a film or a former of each kind inside these storage houses.

Thirdly, the control means include a central processing unit (CPU) adapted to operate the system in different modes according, say, to various software programs. One of such programs is for allowing the user to specify an item to be produced and the system indicates to the user which films and/or formers should be used for the production. This is accomplished by referencing the data stored in the memory device. Another program is for indicating to the user which item or items may be produced by using the former which is already on the packaging machine, that is, without the need for exchanging formers, and which of the films should be used for each of such items. Still another program is for indicating to the user which item or items may be produced by using the film which is already on the packaging machine, that is, without the need for exchanging films, and which of the formers should be used for each of such items. The control means can also be programmed to indicate the storage locations of films and formers which the user may select, or to render the packaging machine inoperative if the former or the film installed thereon is found to be inappropriate for the production of a specified item so as to prevent the production of unmerchantable products.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIGS. 6A, 6B and 6C are schematics of data stored in the read-only memory means on packaging materials, formers and operating conditions of the packaging machine for each of different items to be produced;

FIG. 8 is a block diagram of an equivalent circuit dedicated to the item-specifying mode of operation;

DETAILED DESCRIPTION OF THE INVENTION

Figure 1:
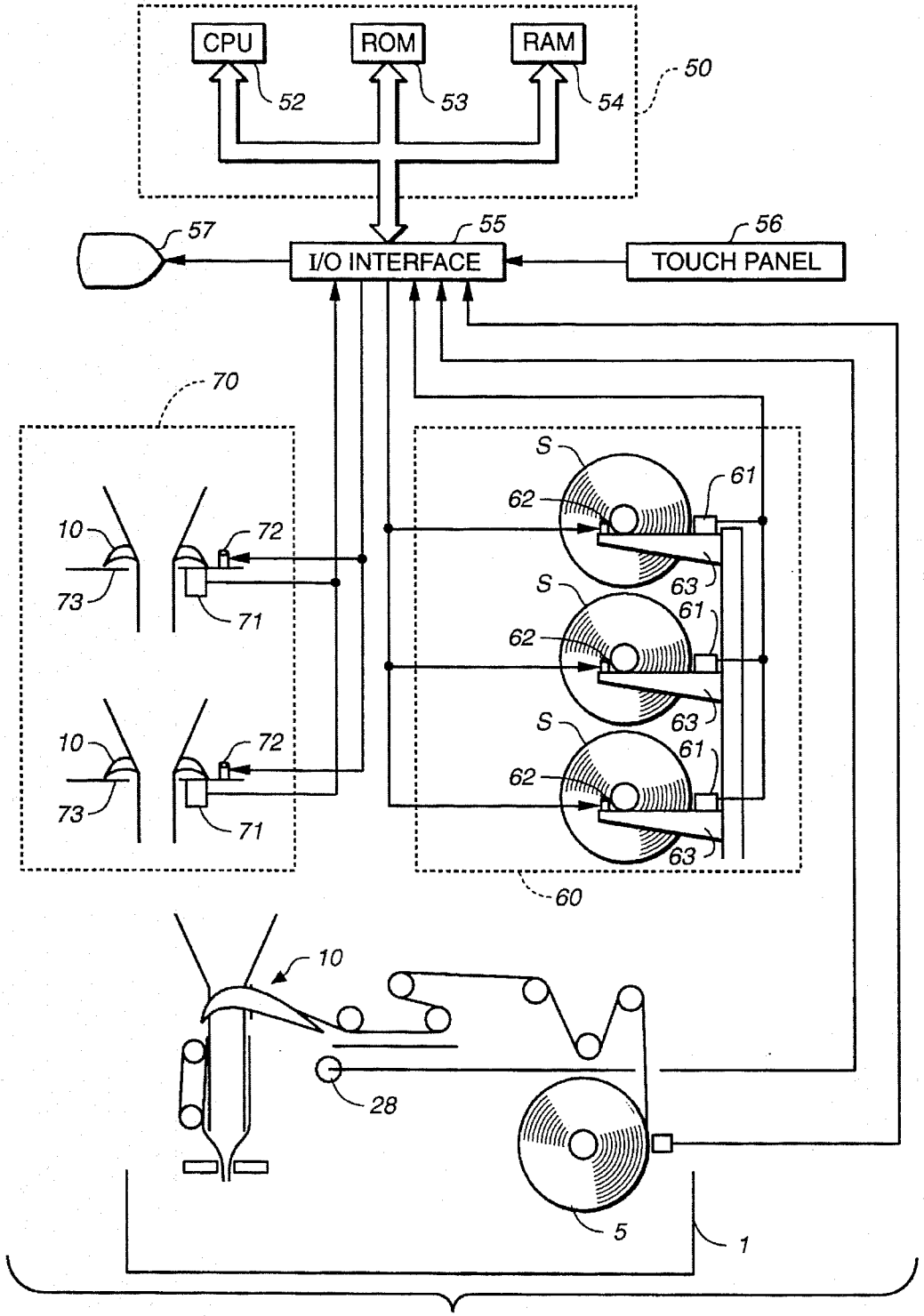
FIG. 1 is a circuit diagram of a packaging system embodying the present invention including a packaging machine.

FIG. 1 is a basic block diagram of a control system for a packaging system embodying the present invention, including a packaging machine 1 and storage houses 60 and 70 for films S and formers 10 therefor. As shown more in detail in FIGS. 2–5, this packaging machine 1 is comprised of a former 10, a cantilevered film supporting device 3 for supporting a film supporting roll 2 around which a film S (serving as a packaging material) is wound, guide rollers 4, 5, 6, 7 and 24 for leading the film S towards the former 10, a diagonally disposed roll 8 for changing the direction of travel of the film S by approximately 90°, a dancer roller 9 for absorbing the tension variations in the film S being pulled out of the roll 2, an adjustment mechanism 20 to be explained in detail below, a longitudinal sealer 40 for sealing together the mutually superposed side edge portions of the film S which has been bent into a tubular form by the former 10, and transverse sealer 41 for end-sealing its upper and lower ends, a pair of left-hand and right-hand pull-down belts 42 for pulling the tubularly formed film S by a negative pressure while transporting it to the transverse sealer 41 and an operation control unit 49, to be explained in detail below, disposed at a front part of the machine.

Figure 5:
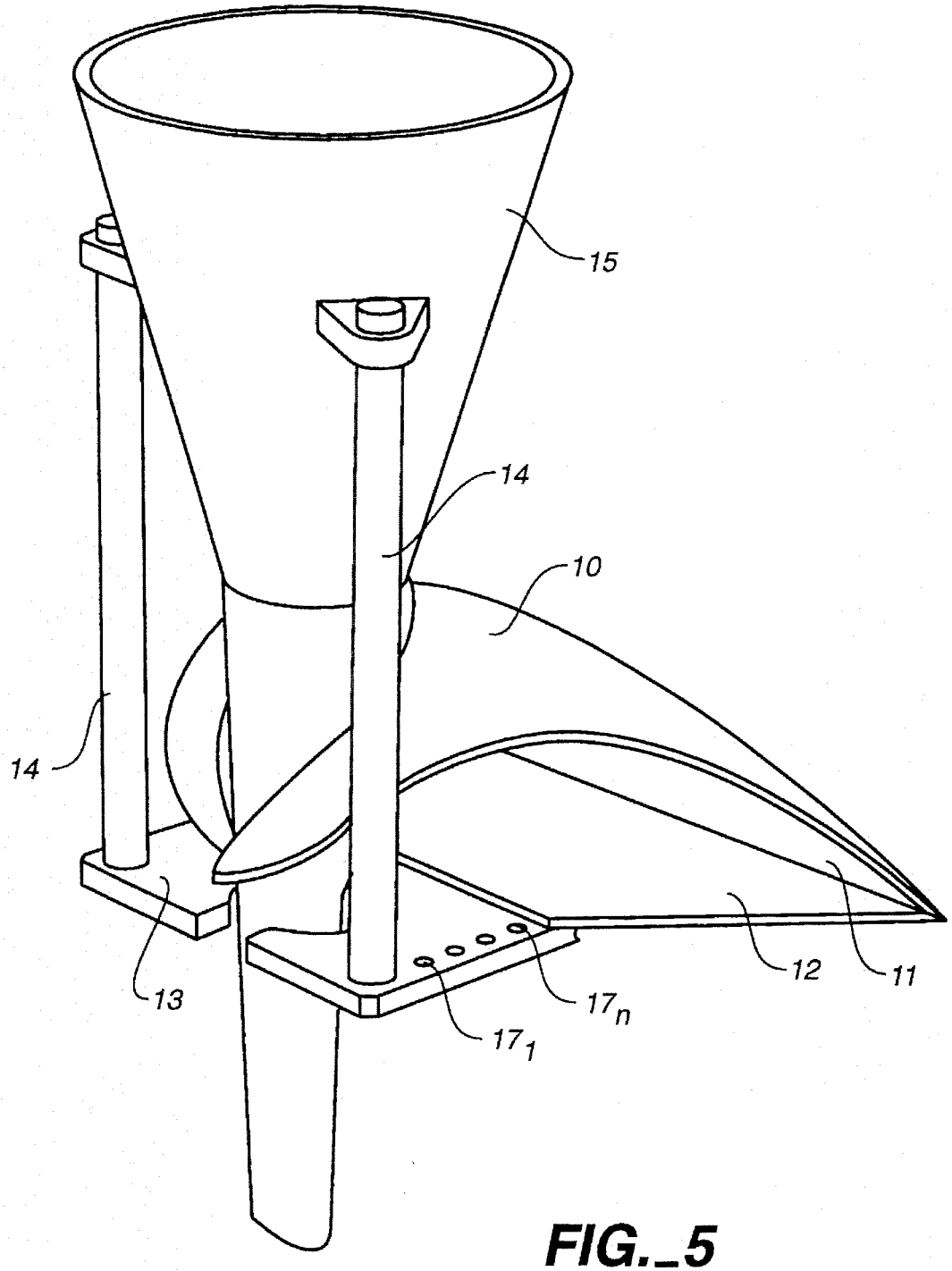
FIG. 5 is a diagonal view of a former.

As shown more clearly in FIG. 5, the former 10 has a skirt-like structure (hereinafter referred to as the skirt) 11 with a folded part 12 affixed to a base 13, and its hopper 15 is supported by supporting columns 14 fastened to the base 13. The base 13 is removably affixed by clamping means (not shown) to a pair of left-hand and right-hand stays 16 (shown in FIG. 3) affixed to a frame 21 of the main body of the packaging machine 1. The base 13 is provided with a plurality of small holes $\mathbf{17}_1 \ldots \mathbf{17}_n$ serving as an identification mark by representing a binary number. The positions of these small holes $\mathbf{17}_1 \ldots \mathbf{17}_n$ (or their presence and absence) are optically detected by a sensor (not shown) on a side part of the stays 16 and adapted to output a signal indicative of the size or identification number of the former 10 to an input/output interface 55 to be described below. In place of these small holes $\mathbf{17}_1 \ldots \mathbf{17}_n$, a bar code may be pasted on the former 10 so that a scanner can be used to identify the former 10.

Formers of different sizes and shapes are used, depending on factors such as the kind of the film S and the size of the bags to be formed. The packaging machine 1 is designed such that the guide roller 24 on the extreme downstream side of the film path can be positioned adjacent to and abutting the skirt 11 so as to cause the film S to travel in contact with the former 10, no matter which of a plurality of available formers is installed. For this purpose, the packaging machine 1 is provided with an encoder on the drive shaft of a screw bar-driving servo motor 28 (to be described below) so as to output a pulse according to the rotation of this motor 28, and data on the stop positions of the guide roller 24 corresponding to different formers 10 are recorded as shown in FIG. 6 in a memory device of a computer in the operation control unit 49 (to be described below) as the numbers of pulses outputted from the encoder corresponding to the distance of travel by the film S until the guide roller 24 is to be stopped.

Figure 3:
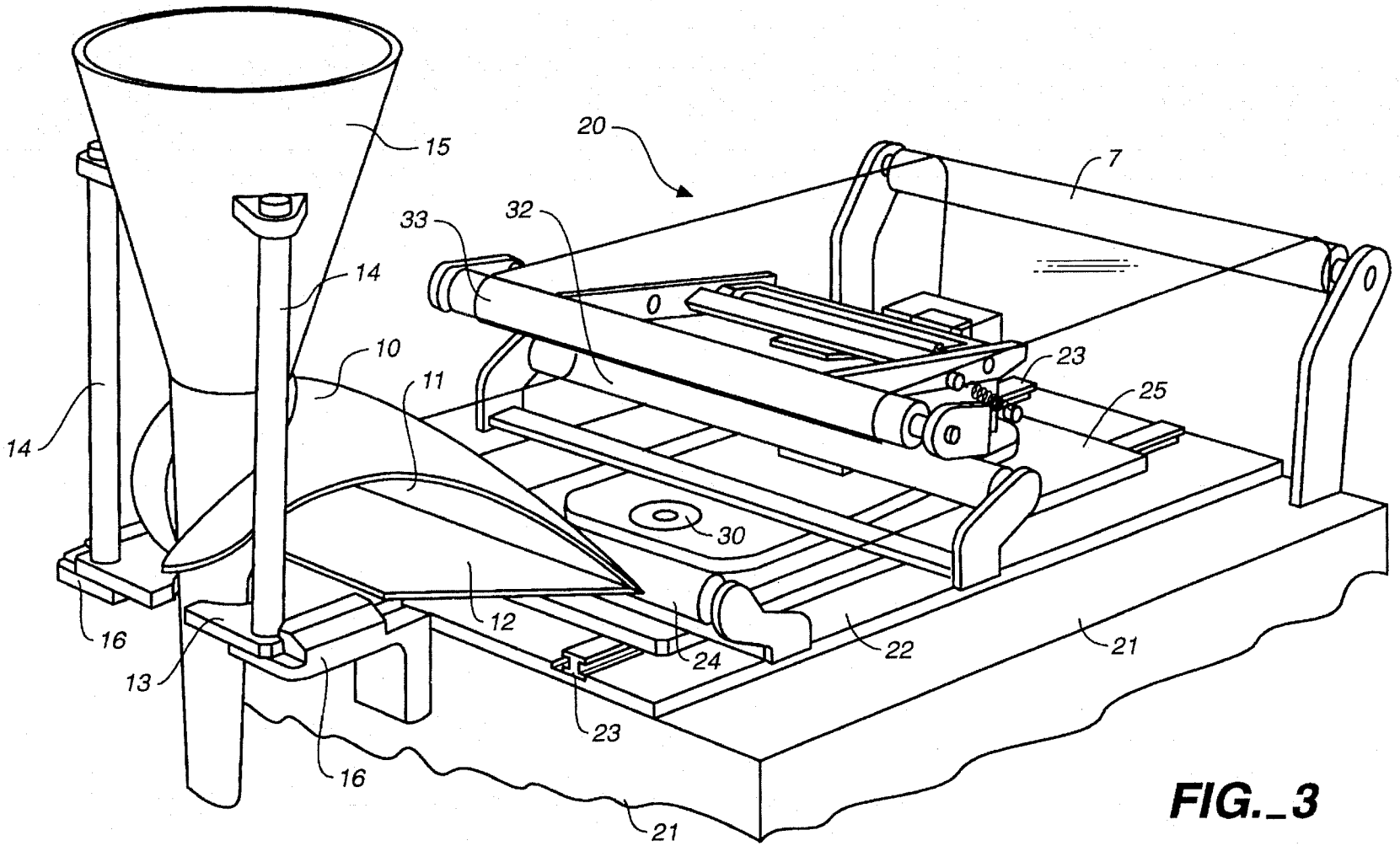
FIG. 3 is a diagonal view of a mechanism on the packaging machine of FIG. 2 for transporting and adjusting the packaging material.
Figure 4:
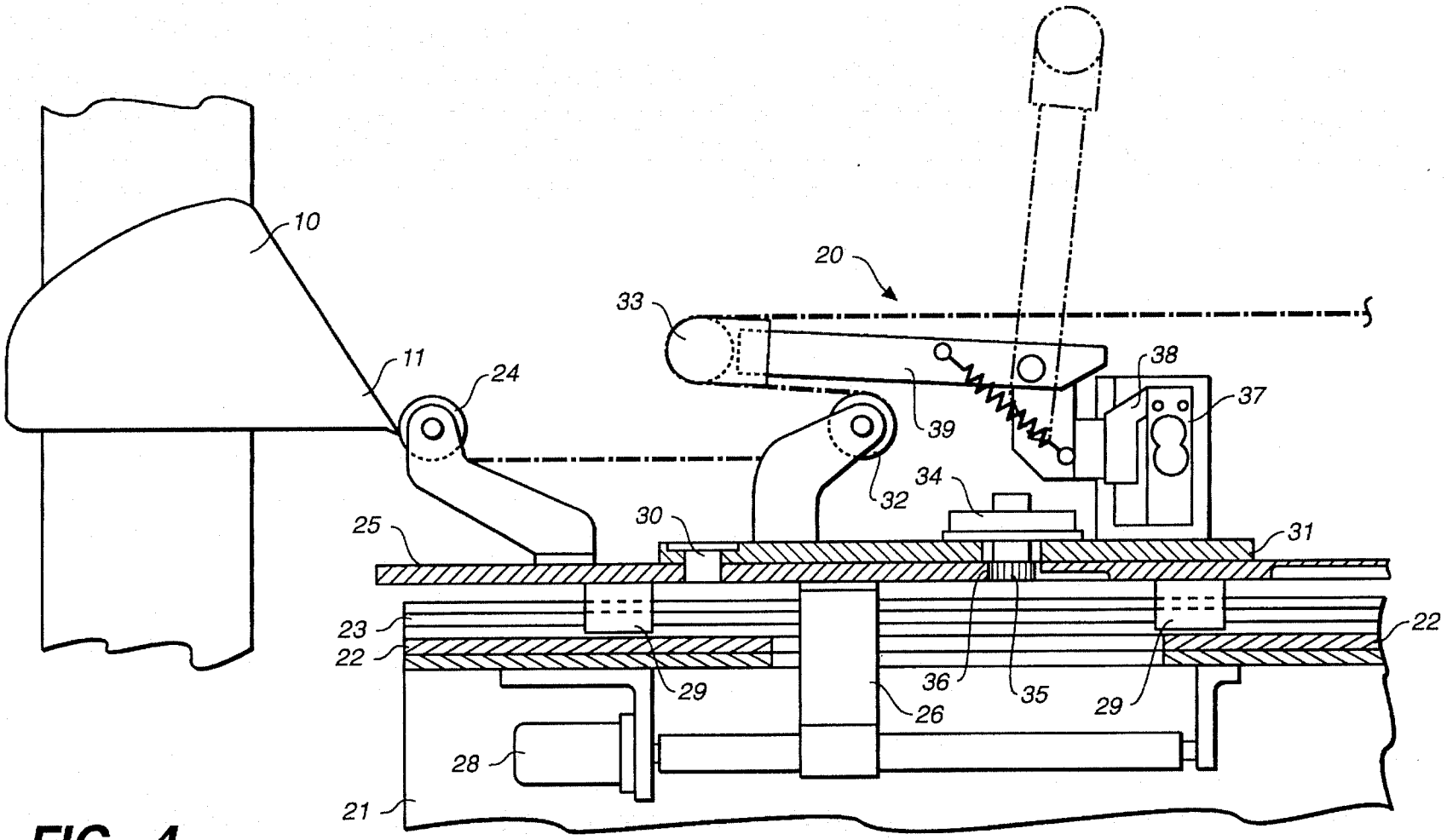
FIG. 4 is a side view of the mechanism of FIG. 3.

As shown more clearly in FIGS. 3 and 4, the adjustment mechanism 20 is composed of a first mechanism for moving it longitudinally with respect to the main body of the packaging machine 1 and a second mechanism for correcting zigzag motions of the film S. On the main body frame 21, the guide roller 7 is disposed away from the former 10, and there are two guide rails 23 on its top surface at the center, extending in the direction of travel of the film S. A sliding plate 25, supporting the guide roller 24 on its front part, is set on these guide rails 23 through linear bearings 29. The sliding plate 25 has legs 26 which penetrate the main body frame 21, extending downward and engaging with a screw bar-27 adapted to be driven by the aforementioned screw bar-driving servo motor 28, such that the sliding plate 25 can be moved longitudinally backward or forward to position the guide roller 24 adjacent to and abutting the back edge of the skirt 11 of the former 10.

The second mechanism for correcting zigzag motions of the film S is comprised of a rotary plate 31 which can rotate to the left or to the right around a support pin 30 at a front part of the sliding plate 25 and a pair of mutually parallel guide rods 32 and 33 on the rotary plate 31. An angle-changing servo motor 34 set on the rotary plate 31 has its pinion 35 engaged with a fan-shaped gear wheel 36 on the sliding plate 25 such that the angle of these guide rods 32 and 33 can be adjusted according to the degree of the zigzag motion of the film S. A load cell 37 for detecting the tension in the film S is affixed to the rotary plate 31. The guide rod 33 (on the upstream side with reference to the travel path of the film S) is attached to one end of a lever 39, which is attached to the load cell 37 rotatably through a bracket 38 so as to be able to assume a standing-up position (shown by broken lines in FIG. 4) or a laid-down position (shown by solid lines in FIG. 4). When the packaging machine 1 is in operation, the lever 39 is laid down such that the upstream guide rod 33 will be between the guide roller 24 in front and the downstream guide rod 32 at a backward position. The film S is passed around these guide rods 32 and 33 in an S-shaped path as shown in FIG. 4 such that its tension can be detected by the load cell 37.

The film supporting roll 2 is supported such that its axis extends in the front-back direction of the main body of the machine 1, and the diagonal roll 8 is disposed with its axis inclined, making an angle of approximately 45° with the direction of the axis of the film supporting roll 2, such that the film S pulled out of the roll 2 will be turned inside out as its direction of travel changes approximately by a right angle. Like the guide rollers 4, 5 and 6, the diagonal roll 8 is installed such that it can be moved horizontally. As it is caused to slide (by a driving means not shown in the figures) in the axial direction of the roll 2, it moves transversely with respect to the direction of travel of the film S such that the center line of the film S can be adjusted so as to advance directly towards the center of the former 10, independently of the width of the film S.

Figure 2:
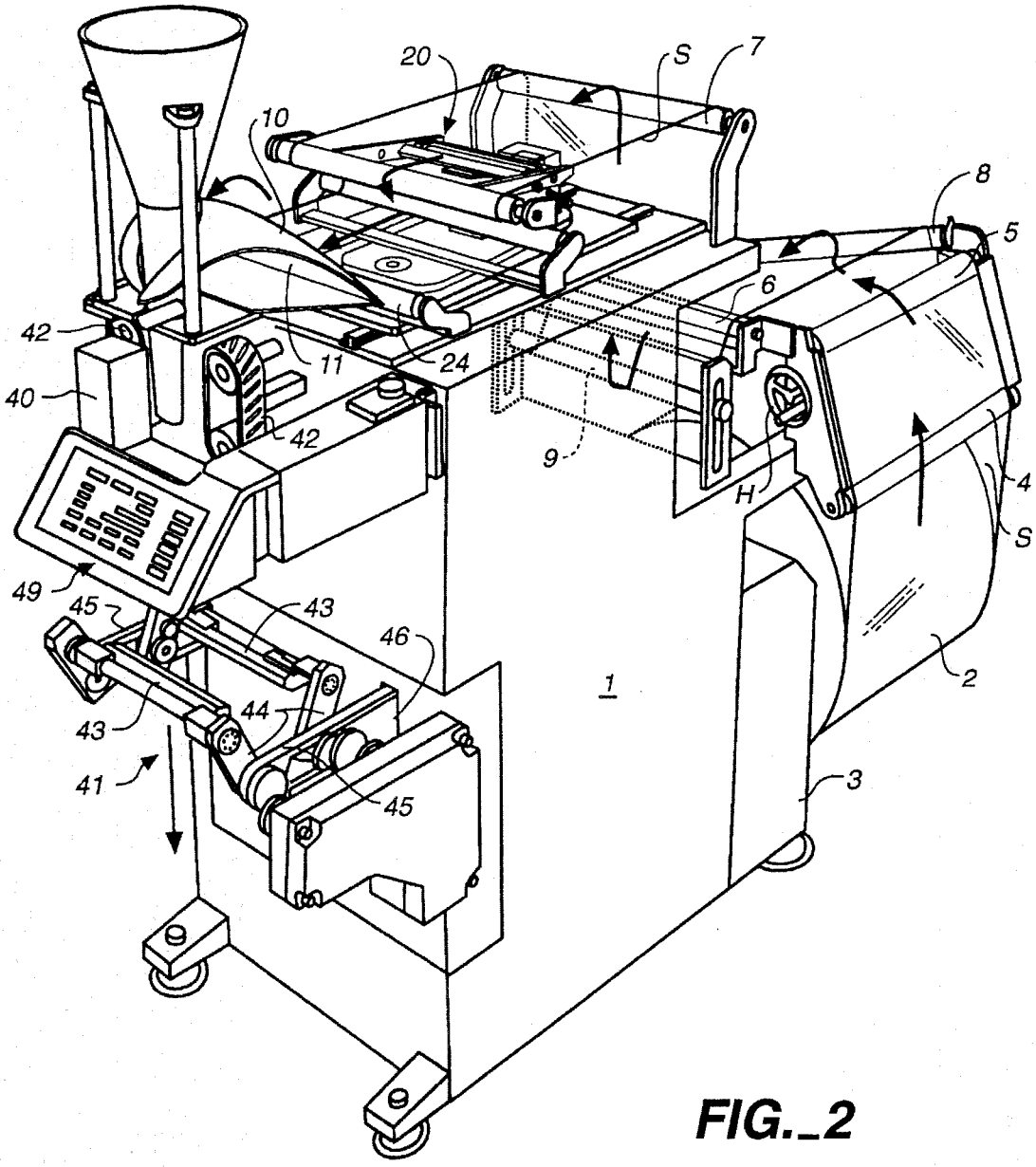
FIG. 2 is a diagonal view of the packaging machine embodying the present invention.

The matching of the center line of the film S with the center of the former 10 can be accomplished by manually operating a handle H shown in FIG. 2, but the packaging machine 1 is adapted to carry out the centering operation automatically according to the kind of film S which is installed because the distance by which the diagonal roll 8 should be shifted is uniquely determined once the kind of the installed film S is known.

As shown in FIG. 2, the transverse sealer 41 is comprised of transverse seal jaws 43, a pair of rotary arms 44 in front and at back for causing the transverse seal jaws 43 to rotate around their axes of rotation while being constantly oriented in the same directions, and pairs of left-hand and right-hand outer and inner mobile frames 45 and 46 for causing the axes of rotation of these rotary arms 44 to move towards or away from each other such that the transverse seal jaws 43 can be caused to move in D-shaped trajectories. The speed of motion of the pull-down belts 42 and the frequency of rotation of the transverse seal jaws 43 are variable such that the length of the produced bags (that is, the distance between the upper and lower end seals) can be adjusted to a specified value. Since data on films and formers for each item to be produced, as well as data on speeds of machine parts in operation, are stored in the memory device of the computer to be described in detail below, these data are relied upon by a control unit (not shown) to control the speed of the pull-down belts 42 and the rotary motion of the transverse seal jaws 43 for continuously producing bags of a desired length.

The operation control unit 49 is provided with a display screen 57 on which names of items to be produced can be displayed in the form of a menu such that the user can specify one of the names in the menu through a touch panel. A TV camera (not shown) may be provided to the machine 1 such that the pictorial design on the film S installed on the machine 1 can be thereby analyzed and converted into color or pattern data to be displayed. Alternatively, a scanner may be used to read the bar code printed on each film S. The identity of each of the formers 10 can be ascertained and displayed on the basis of the positions of the small holes $\mathbf{17}_1 \ldots \mathbf{17}_n$ on its base 13 as detected optically by a sensor (not shown) or by using a scanner to detect a bar code pasted on the former 10, as explained above.

These detecting devices such as the TV camera and the scanner for outputting former-identifying and film-identifying signals may be installed at any convenient position on the packaging machine 1, for example, near the film roll 2 around which the film S is wound or near the former 10. If necessary, such devices may be installed also in the storage houses 60 and 70. In such a situation, they may be installed on shelves 63 and 73 at each of film and former storage locations, as schematically shown in FIG. 1.

When a former-indicating signal or a film-indicating signal is received from such a detecting device, corresponding data on items, films and formers are retrieved from the memory device. If the retrieved data relate to operating conditions of the packaging machine 1, the control unit accordingly adjusts the speed of the pull-down belts 42, the rotary motion of the transverse seal jaws 43, etc. If the received data relate to the distance by which the diagonal roll 8 is to be moved, the control unit automatically adjusts the position of the diagonal roll 8 accordingly. If location data indicating the storage locations of certain films and/or formers are received, these locations may be displayed on the screen or corresponding display lamps 62 and 72 on the storage shelves 63 and 73 are switched on.

FIG. 1 shows the circuit structure capable of controlling the operation of the packaging system in various modes to be described below. In FIG. 1, numeral 50 indicates a microcomputer for generally controlling the operation of the system including the packaging machine 1. This microcomputer 50 is contained in the operation control unit 49 shown in FIG. 2, and data can be inputted thereinto through a transparent touch panel superposed on the display screen at its front. As schematically shown in FIG. 1, the microcomputer 50 is comprised of a central processing unit (CPU) 52, a read-only memory (ROM) device 53 serving as means for storing initial data, and a random-access memory (RAM) device 54 for temporarily storing data on items to be produced, the films S and formers 10 in the storage houses 60 and 70, and the installed film S and former 10 which are currently on the packaging machine 1. In addition to a touch panel 56 on the operation control unit 49, the microcomputer 50 is also connected to various detectors 61 and 71 serving as film/former data outputting means, a display screen 57 for displaying various data, and the display lamps 62 and 72 on the storage shelves 63 and 73.

Figures 6C, 8:
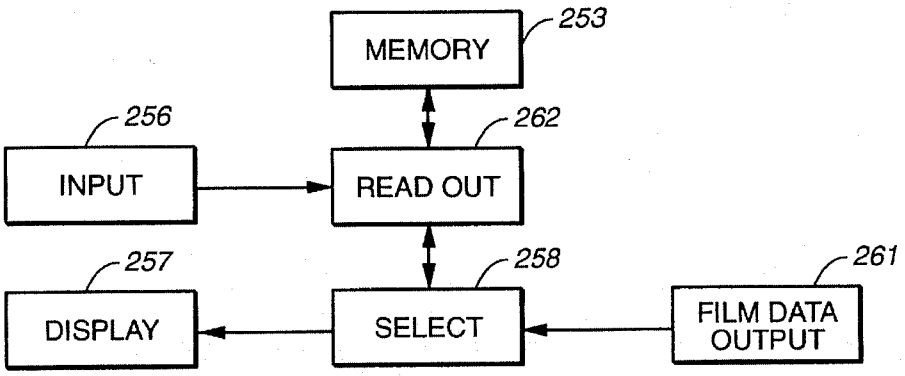

Data can be written into the read-only memory device 53, for example, by a hardware method using key switches or from a keyboard. FIGS. 6A, 6B and 6C show how inputted data on the films S, the formers 10 and other operational information such as the distance by which the diagonal roll 8 is to be moved, operation speeds and sealing conditions may be stored for each item to be produced.

The detectors 61 for the stored films S, as well as the display lamps 62 therefor, are provided individually to the shelves 63 in the storage house 60 for storing the films S. These film detectors 61 are adapted to each identify the kind of the film S at the corresponding storage location from the bar code attached to the film S, from the pattern of the edge-detection marks on the film S or from the pictorial patterns on the film S, and to output the detected data to the microcomputer 50. Similarly, the detectors 71 serving as former data outputting means, as well as the display lamps 72 therefor, are provided individually to the shelves 73 in the storage house 70 for storing the formers 10. These former detectors 71 are each adapted to output data such as the size and the identification number of the former 10 at the corresponding storage location to the microcomputer 50 by optically detecting the small holes $17_1 \ldots 17_n$ on its base 13 as shown in FIG. 5.

In what follows, flow charts and block diagrams will be referenced to describe various modes in which the packaging system structured as described above can be operated. According to a preferred embodiment of the invention, operations of the system are controlled by software and the microcomputer 50 of its control unit controls the operation of the system in these modes according to different software programs stored in its memory device 53.

Figure 7:
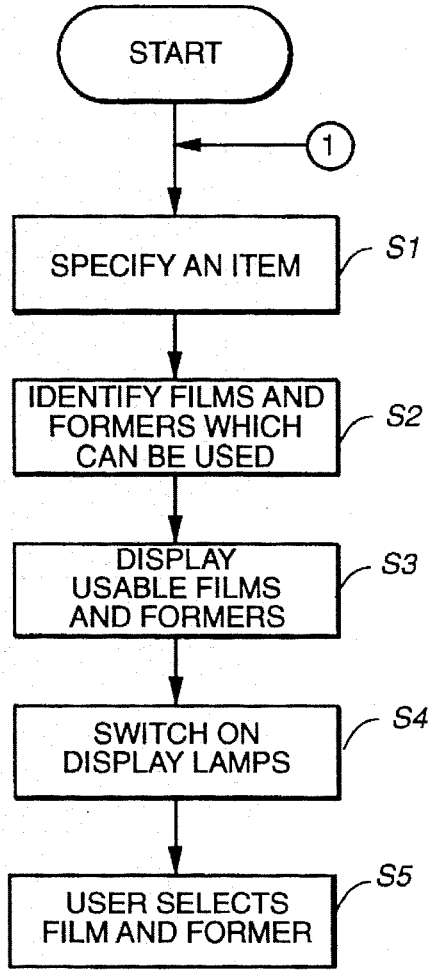
FIG. 7 is a flow chart of the item-specifying mode of operation.

FIG. 7 is a flow chart showing the item-specifying mode of operation wherein the user specifies an item and the system indicates to the user which of the plurality of available films and formers should be used according to data which are preliminarily stored as shown, for example, in FIGS. 6A, 6B and 6C.

Let us assume that Item A is among the items to be produced according to a production schedule for the day handed to the user and that the user decides to start the day with the production of Item A. The user thereupon presses the touch panel 56 serving as input means where it is marked "Item A" (Step S1), thereby sending an item-indicating signal through the interface 55 to the CPU 52. In response, the CPU 52 looks inside the read-only memory device 53 storing data as shown in FIGS. 6A, 6B and 6C and identifies the films and formers which may be selected and installed on the packaging machine 1 for producing the specified item (Step S2). Descriptions of the film (or films) and former (or formers) which may be used for the production of the specified item (Item A in this situation) such as the identification number and the pictorial pattern on the film are displayed on the display screen 57 (Step S3).

In the meantime, data related to the identities and locations of the films and formers stored in the storage houses 60 and 70 are transmitted from the film and former detectors 61 and 71 through the interface 55 and temporarily stored in the random-access memory device 54. These data are compared with the aforementioned data on the selectable films and formers, and the CPU 52, determining the locations of these selectable films and formers, switches on those of the display lamps 62 and 72 indicating their locations (Step S4). In summary, the user has only to indicate an item, and not only does the display screen 57 show which film (or films) and former (or formers) may be installed for the job but also the locations of these selectable film (or films) and former (or formers) are indicated by display lamps 62 and 72.

As a simplified variation of the above, the system may be controlled such that when the user specifies an item to be produced (such as Item A), only the films which may be used will be displayed. Such a simplified program may be sufficient where the available formers are small in number and/or easily distinguishable. FIG. 8 is a block diagram of an equivalent dedicated circuit for controlling the system in such a simplified item-specifying mode of operation. In FIG. 8, numeral 261 indicates a film data outputting means (like the film detectors 61 of FIG. 1) for outputting signals indicative of the identities of the films at the individual storage locations inside the film storage house 60. Numeral 253 indicates a memory means for storing data as shown in FIGS. 6A, 6B and 6C. If the user specifies from an input means 256 an item to be produced, data on the film (or films) to be used for the production of the specified item are retrieved from the memory means 253 by a read out means 262 and compared by a selecting means 258 with the aforementioned film-identifying signals outputted from the film data outputting means 261. The selecting means 258 thereby causes a display means 257 to display the storage locations, identification numbers and/or other identifying characteristics of each of the films that may be selected for the job. The display screen 57 and the display lamps 62 shown in FIG. 1 correspond to the display means 257 of FIG. 8.

As another simplified variation of the above, the system may be controlled such that when the user specifies an item to be produced (such as Item A), only the formers which may be used will be displayed. An equivalent dedicated circuit for controlling the system in such a manner can be represented by a block diagram which is nearly identical to the one shown in FIG. 8 (and hence will not be shown), except the film data outputting means 261 of FIG. 8 is replaced by a former data outputting means (like the former detectors 71 of FIG. 1).

In the description of the item-specifying mode of operation above, it was assumed that the storage houses 60 and 70 are so managed that formers and the films are allowed to be stored at random locations therein. If the storage houses 60 and 70 are so managed that each film and/or former is assigned a predetermined storage location, the film and/or former detectors 61 and/or 71 may be dispensed with and the film data outputting means 261 and/or the former data outputting means may similarly be omitted from the block diagram of FIG. 8.

If the user thereupon installs on the packaging machine 1 a film and a former according to the indication on the display screen 57, the screw bar-driving servo motor 28 causes the screw bar 27 to rotate such that the sliding plate 25, which has been retracted so as not to stand in the way of the user exchanging formers, advances forward until the guide roller 24 at its front part reaches the edge of the skirt 11. When the rotation of the screw bar 27 is stopped, the packaging machine 1 is ready to start producing the specified item.

Figure 9:
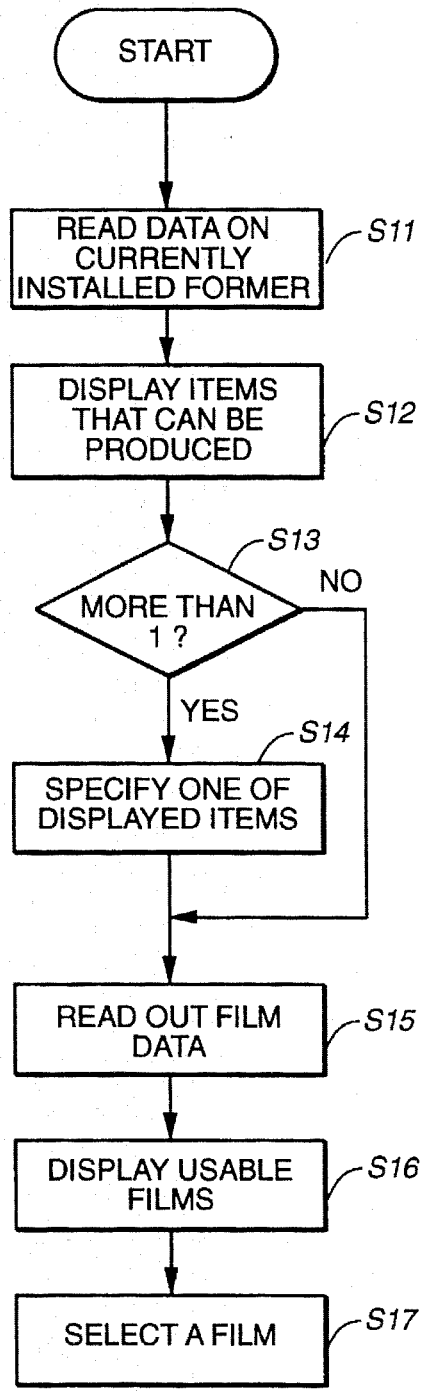
FIG. 9 is a flow chart of the former-specifying mode of operation.

Next, FIG. 9 is referenced to describe the former-specifying mode of operation wherein the kind of former which is presently installed on the packaging machine 1 is identified and the user is informed which items may be produced by using the same former and which of the films should be used for such production. As explained above, this mode of operation is useful when, for example, the former which was used in the previous production process remains installed on the packaging machine 1. In such a situation, the CPU 52 can identify the former by receiving former-identifying signals from the former identification means 17 thereon, and reviews the contents of the memory device 53 to read out data on this former (Step S11). The data will include not only those on the former itself but also those on items that may be produced by using the same former, and such data are displayed on the display screen 57 (Step S12), say, in the form of a menu. If only one item is displayed as being suited for production by using this former (NO in Step 13), the user will probably decide to produce this item and the CPU 52 looks inside the memory device 53 to decide which of the films should be used for the job (Step S15). If two or more items are displayed as being suited for production by using this former (YES in Step 13), the user is allowed to specify either of them. The user may then consult the production schedule for the day, and if one of them is selected on the touch panel 56 serving as input means (Step S14), the CPU 52 again reviews the contents of the memory device 53 to decide which of the films should be used for the job (Step S15). A list of such films suitable for the job is displayed on the display panel 57 (Step S16). At the same time, display lamps 62 at the storage locations of these suitable films are switched on. The user selects one of the suitable films (Step S17), retrieves it from its storage location indicated by a lit display lamp and installs it on the packaging machine 1 to start the packaging operation.

Figure 10:
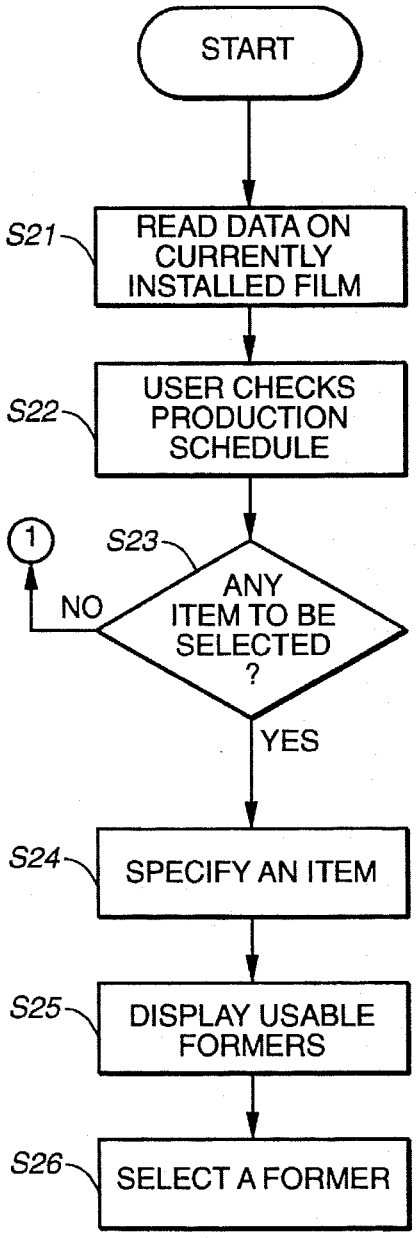
FIG. 10 is a flow chart of the film-specifying mode of operation.

In the film-specifying mode of operation illustrated in FIG. 10, the film which is currently installed on the packaging machine 1 is identified, and the user is informed which items may be produced by using this film and which former should be used for such production according to the data stored in the memory device 53. This mode of operation is useful when, for example, the film which was used in the previous production process remains installed on the packaging machine. In such a situation, the CPU 52 identifies the film by receiving film-identifying signals from a detection sensor (not shown) attached, for example, near the film roll 2 and reviews the contents of the memory device 53 to read out data on this film (Step S21). Upon learning thereby which items may be produced by using the same film, the user then checks the production schedule for the day (Step S21). If it is learned that none of the items to be produced according to the production schedule for the day requires the use of the film currently on the packaging machine 1 (NO in Step S23), the user leaves this mode of operation and enters the item-specifying mode of operation from Step S1. If at least one of the items to be produced for the day requires the use of the film now on the packaging machine 1 (YES in Step S23), the user selects one of them on the touch panel 56 (Step S24), causing the display screen 57 to display which of the formers should be used for producing the selected item (Step S25). The user selects one of the displayed formers (Step S26) and installs it on the packaging machine 1 to get ready for the production process.

Figure 11:
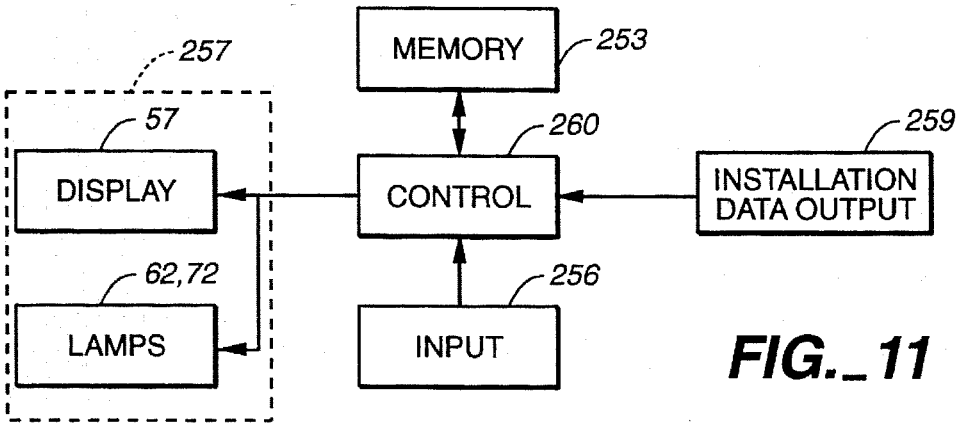
FIG. 11 is a block diagram of an equivalent circuit dedicated to the film-specifying or former-specifying mode of operation.

FIG. 11 is a block diagram of an equivalent circuit dedicated to the control of the system in the aforementioned former-specifying or film-specifying mode of operation, that is, for selecting a film (or a former) suited for a specified item to be produced by using the same former (or the film) already on the packaging machine 1. In FIG. 11, numeral 253 indicates a memory means (such as the read-only memory device 53 of FIG. 1) storing data of various kinds on the films and the formers as shown in FIGS. 6A, 6B and 6C. Numeral 259 indicates an installation data outputting means for outputting signals indicative of the film or the former currently installed on the packaging machine 1. In the case of a film, the pictorial patterns thereon or the bar code printed thereon may be outputted. In the case of a former, the former identification marks 17 may be scanned to ascertain its identity. The signals identifying the film or the former on the packaging machine 1 are received by a control means 260 such as the CPU 52 which compares the received signals with the contents of the memory means 253 and causes a display means 257 to display which items may be produced by using the former or the film now on the packaging machine 1. Numeral 256 indicates an input means such as the touch panel 56 through which the user may select one of the displayed items. The control means 260 is adapted to respond to such an input by causing the display means 257 to display which films (or formers) may be used for the production of the selected item. If the storage houses 60 and 70 are managed such that formers and films can be stored at random locations, the locations of the selectable films or formers are also indicated by lighting the corresponding display lamps 62 or 72.

Figure 12:
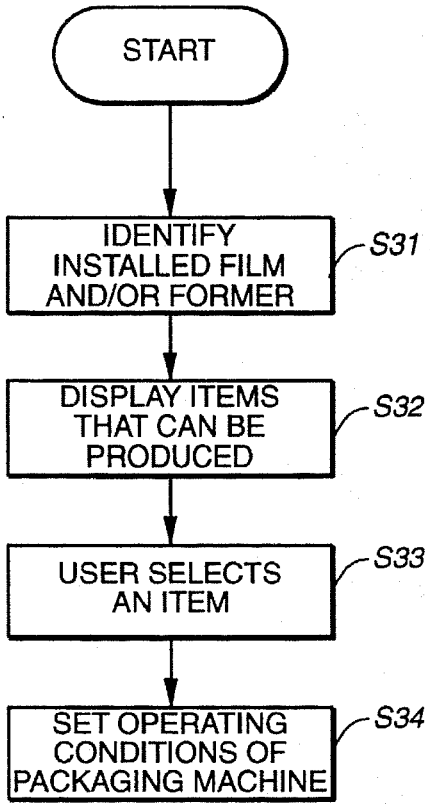
FIG. 12 is a flow chart of the condition-setting mode of operation.
Figure 13:
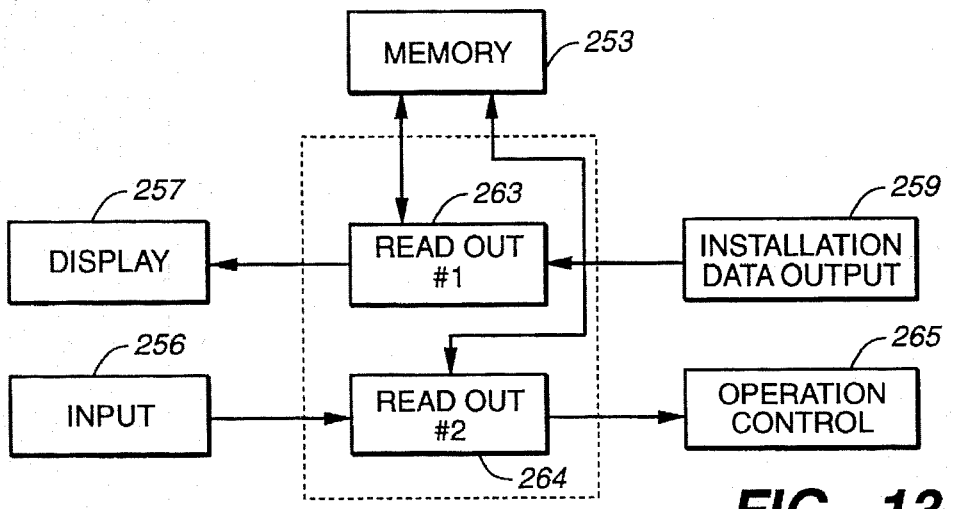
FIG. 13 is a block diagram of an equivalent circuit dedicated to the condition-setting mode of operation.
Figure 15:
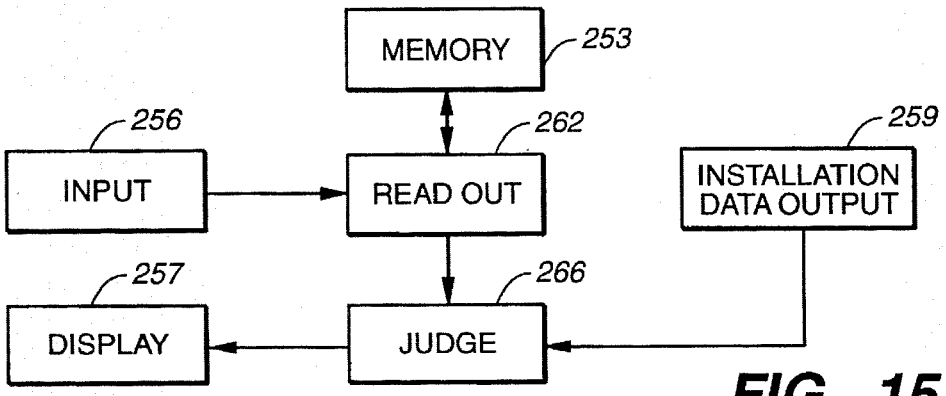
FIG. 15 is a block diagram of an equivalent circuit dedicated to the installation-checking mode of operation.
Figure 17:
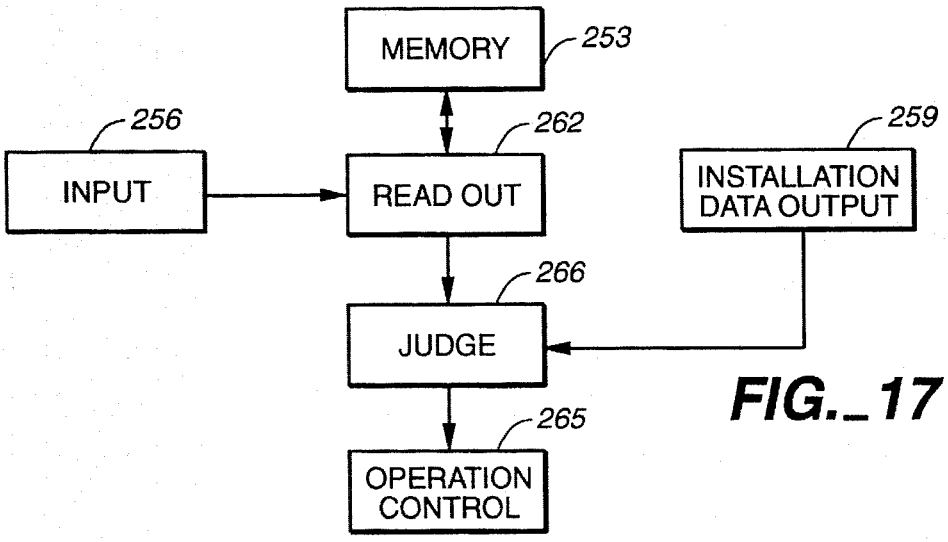
FIG. 17 is a block diagram of an equivalent circuit dedicated to the operation-disabling mode of operation.
Figure 14:
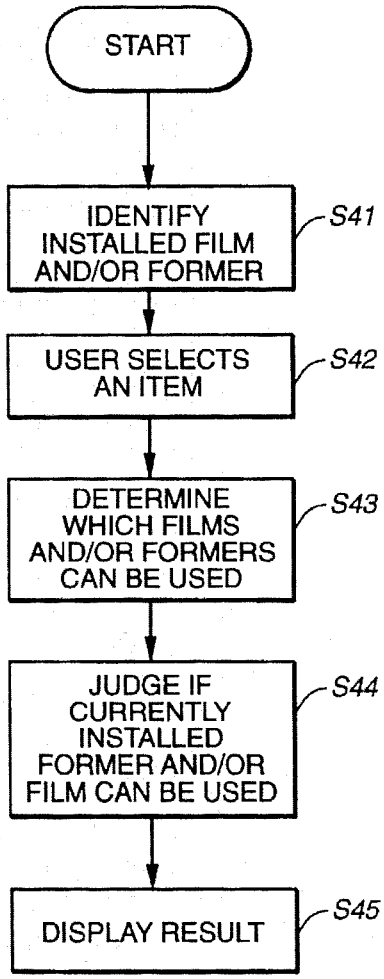
FIG. 14 is a flow chart of the installation-checking mode of operation.

In addition to the modes of operation described above, the system can be operated also in a condition-setting mode (shown in FIGS. 12 and 13) wherein the conditions for the operation of the packaging machine 1 are automatically adjusted in a manner suited for the production of a specified item, an installation-checking mode (shown in FIGS. 14 and 15) wherein the system indicates to the user whether the film or the former which is currently on the packaging machine 1 is appropriate for the production of a specified item, and an operation-disabling mode (shown in FIGS. 16 and 17) wherein the packaging machine 1 is automatically rendered inoperative if an incorrect film or former is found to be installed for the production of a specified item. These three additional modes of operation will be explained next each by way of both a flow chart for its software implementation (FIG. 12, 14 or 16) and a block diagram of an equivalent dedicated circuit (FIGS. 13, 15 or 17). In these block diagrams, components which are like those already explained above are indicated by the same numerals for the sake of convenience.

In all these three modes of operation, former and film data as shown in FIGS. 6A, 6B and 6C are stored in the memory means 253 and the former and/or the film currently installed on the packaging machine 1 is constantly monitored by the installation data outputting means 259. In the condition-setting mode of operation, signals from the installation data outputting means 259 are received by a first read out means 263 (Step S31), of which the function is to look inside the memory means 253 and to determine which items may be produced by using the former and/or the film currently on the packaging machine 1, causing them to be displayed on the display means 257 (Step S32), say, in the form of a menu. If the user specifies one of them through the input means 256 (Step S33), the conditions for operating the packaging machine 1 for the production of the specified item are automatically set by a second read out means 264 according to the data stored in the memory means 253 (Step S34). The conditions of operation may include the speed of motion, the length of the bags to be formed, sealing conditions such as the temperature, time and pressure, tension parameters for the film being transported, the position at which the adjustment mechanism 20 should be stopped and the offset distance for matching the center line of the film with the center of the former. The conditions are selectively determined for each packaging machine 1 and stored as shown in FIGS. 6A, 6B and 6C. Numeral 265 indicates an operation control means for causing the packaging machine 1 to operate according to the set conditions. If a length of the bags to be formed is read out, for example, the operation control means 265 serves to carry out the end sealing at a pitch which will correspond to this length. If an offset value is read out, the trajectory of the film will be shifted transversely by the indicated distance.

In the installation-checking mode of operation, too, the kind of the former and/or film currently installed on the packaging machine 1 is constantly monitored by the installation data outputting means 259 (Step S41). If the user specifies through an input means 256 an item to be produced (Step S42), say, by inputting a pre-assigned call number associated therewith, a read out means 262 looks inside the memory means 253 and determines which of the formers and films may be used for producing the specified item (Step S43). Numeral 266 indicates a judging means which serves to compare the aforementioned information from the installation data outputting means 259 and the output from the read out means 262, thereby judging whether the film and/or the former currently installed on the packaging machine 1 can be used for the production job according to the data in the memory means 253 (Step S44). The result of this judgment may be displayed on the display means 257 (Step S45), or a warning device may be activated in an attempt to prevent an error in the choice of film or former.

Figure 16:
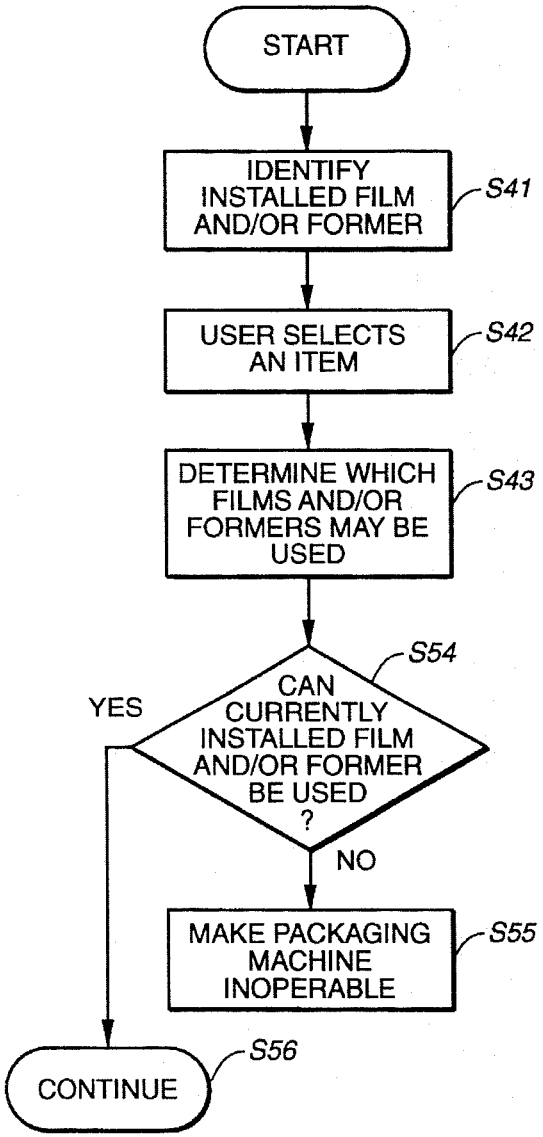
FIG. 16 is a flow chart of the operation-disabling mode of operation.

The operation-disabling mode of operation is for making the packaging machine 1 inoperative unless a film and a former both appropriate for the production of a specified item are installed. As shown in FIG. 16, the operation-disabling mode of operation and the installation-checking mode of operation start alike. In the operation-disabling mode of operation, however, if the judgment means 266 determines that the currently installed former or film is not suitable for the production of the specified item according to the data read from the memory means 253 (NO in S54), the packaging machine 1 is rendered inoperable by an operation control means 265 (Step S55) in order to prevent the production of defective products. Only if the judging means 266 determines that both the film and the former currently installed on the packaging machine 1 are appropriate (YES in S54), the operation control means 265 allows the packaging machine 1 to continue the production process (Step S56).

Although the present invention has been described above by way of packaging systems including only one packaging machine, this is not intended to limit the scope of the invention. In a system including a plurality of packaging machines to which films and formers are to be supplied from common storage houses, rails may be provided between each of the storage houses and the individual packaging machines, and a trolley which runs thereon may be made controllable by selection signals from a microcomputer such that appropriate films and formers can be automatically delivered to the packaging machines according to the items to be produced thereby.

Although the use of a touch panel was described above for specifying items to be produced, such data may be inputted into a host computer or a memory card, say, according to a production schedule. In short, the specification is intended to be interpreted broadly and such modifications and variations of the disclosure that may be apparent to a person skilled in the art are to be considered to be included within the scope of the invention.

What is claimed is:

1. A packaging machine comprising:

memory means for storing data on films and formers corresponding to each of merchandises;

data input/output means for inputting and outputting data on any one of said merchandises, stored films and formers, an installed film on said packaging machine, and an installed former on said packaging machine; and selecting means for comparing said data from said memory means and said data input/output means to thereby select, (1) if one of said merchandises is specified, those of said formers and those of said films which are suited for use for said specified merchandise;

(2) if said installed film is specified, those of said merchandises and those of said formers which are suited for use with said installed film; and (3) if said installed former is specified, those of said merchandises and those of said films which are suited for use with said installed former.

2. A packaging machine comprising:

memory means for storing film data corresponding to each of different merchandises;

input means for specifying one of said merchandises; and selecting means for reading out from said memory means one of said film data corresponding to said specified merchandise and selecting a film to be used.

3. A packaging machine comprising:

film data output means for outputting data on each of stored films;

memory means for storing data on films to be used for each of different merchandises;

input means for specifying one of said merchandises;

selecting means for retrieving from said memory means film data corresponding to said specified merchandise, comparing said retrieved data and each of said film data from said film data output means, and thereby selecting suitable films to be used; and display means for displaying said selected films.

4. The packaging machine of claim 3 wherein said display means is capable of indicating the locations where said selected films are stored.

5. The packaging machine of claim 3 wherein said display means includes display lamps on shelves for storing films.

6. A packaging machine comprising:

memory means for storing former data corresponding to each of different merchandises;

input means for specifying one of said merchandises; and selecting means for reading out from said memory means one of said former data corresponding to said specified merchandise and selecting a former to be used.

7. A packaging machine comprising:

former data output means for outputting data on each of stored formers;

memory means for storing data on formers to be used for each of different merchandises;

input means for specifying one of said merchandises;

selecting means for retrieving from said memory means former data corresponding to said specified merchandise, comparing said retrieved data and each of said former data from said former data output means, and thereby selecting a suitable former to be used; and display means for displaying said selected former.

8. The packaging machine of claim 7 wherein said display means is capable of indicating the location where said selected former is stored.

9. The packaging machine of claim 3 wherein said display means include display lamps on shelves for storing formers.

10. A packaging machine comprising:

memory means for storing data on films (or formers) to be used for each of different merchandises;

input means for specifying one of said merchandises;

installation data output means for outputting data on installed one of said films (or formers); and selecting means for determining from said memory means suitable ones of said merchandises corresponding to said installed film (or former) on the basis of output data from said installation data output means and selecting other formers (or films) which correspond to a specified one of said suitable merchandise.

11. A packaging machine comprising:

memory means for storing data on operation conditions, films and formers corresponding to each of different merchandises;

installation data output means for outputting data on installed one of said films (or formers); and operation control means for retrieving from said memory means suitable ones of said merchandises corresponding to said installed film (or former) on the basis of output data from said installation data output means and controlling the operation of said packaging machine according to the operation condition corresponding to a selected one of said suitable merchandises.

12. A packaging machine comprising:

memory means for storing data on films and formers corresponding to each of different merchandises;

input means for specifying one of said merchandises;

installation data output means for outputting data on installed one of said films (or formers); and judging means for retrieving from said memory means data on films (or formers) corresponding to a specified merchandise, and comparing said retrieved data and output data from said installation data output means to thereby determine whether or not said installed film (or former) is appropriate.

13. The packaging machine of claim 12 further comprising control means for allowing or not allowing said packaging machine to operate, depending of the results of determination by said judging means.

* * * * *